US008146237B2

(12) United States Patent
Ito et al.

(10) Patent No.: US 8,146,237 B2
(45) **Date of Patent: *Apr. 3, 2012**

(54) METHOD OF MANUFACTURING A MAGNETIC HEAD

(75) Inventors: Yoshiaki Ito, Shatin (HK); Osamu Fukuroi, Shatin (HK); Hiroyasu Tuchiya, Shatin (HK); Kenji Kodaka, Chuo-ku (HK)

(73) Assignee: SAE Magnetics (H.K.) Ltd., Shatin, N.T. (HK)

( * ) Notice: Subject to any disclaimer, the term of this patent is extended or adjusted under 35 U.S.C. 154(b) by 123 days.

This patent is subject to a terminal disclaimer.

(21) Appl. No.: 12/387,129

(22) Filed: Apr. 28, 2009

(65) Prior Publication Data

US 2009/0208777 A1 Aug. 20, 2009

Related U.S. Application Data

(62) Division of application No. 11/281,985, filed on Nov. 16, 2005, now Pat. No. 7,712,205.

(30) Foreign Application Priority Data

Nov. 16, 2004 (JP) ..... 2004-332180

(51) Int. Cl.
*G11B 5/127* (2006.01)
*H04R 31/00* (2006.01)

(52) U.S. Cl. ..... 29/603.16; 29/603.12; 29/603.15; 29/603.18; 360/321; 360/324.2; 451/5; 451/41

(58) Field of Classification Search ..... 29/603.12, 29/603.15, 603.16, 603.18, 417; 451/5, 8, 451/10, 28, 36, 37, 41; 360/324.2, 321
See application file for complete search history.

(56) References Cited

U.S. PATENT DOCUMENTS 5,095,613 A * 3/1992 Hussinger et al. ..... 29/603.17
5,603,156 A * 2/1997 Biskeborn et al. ..... 29/603.16
5,749,769 A * 5/1998 Church et al. ..... 451/5

* cited by examiner

*Primary Examiner* — Paul D Kim
(74) *Attorney, Agent, or Firm* — Jordan and Hamburg LLP

(57) ABSTRACT

In a magnetic head manufacturing method, a floated surface of each block having plural magnetic head elements formed and arranged on a substrate is ground and lapped in a grinding/lapping step. The grinding/lapping step contains an angle adjusting step for adjusting the angle of the floated surface of the block with reference to a magnetic-head-element formed surface of a substrate and grinding the floated surface concerned, and a finishing lapping step of lapping the floated surface at an angle adjusted in the angle adjusting step.

4 Claims, 7 Drawing Sheets

METHOD OF MANUFACTURING A MAGNETIC HEAD

REFERENCE TO RELATED APPLICATION

This is a divisional application of Ser. No. 11/281,985, filed Nov. 16, 2005 now U.S. Pat. No. 7,712,205. The subject matter of the aforementioned prior application is hereby incorporated herein by reference.

BACKGROUND OF THE INVENTION

The present invention relates to a method of manufacturing a magnetic head having a writing element for writing information into a recording medium by a perpendicular magnetic recording system and a reading element for reading out information recorded in the recording medium.

As a recording system for a magnetic recording and reproducing device have been known a longitudinal magnetic recording system in which the signal magnetization direction is set to a direction within the plane of a recording medium, and a perpendicular magnetic recording system in which the signal magnetization direction is set to a direction perpendicular to the plane of the recording medium. It is said that the perpendicular magnetic recording system is less influenced by thermal fluctuation of the recording medium as compared with the longitudinal magnetic recording system and thus can implement high linear recording density. Accordingly, the vertical magnetic recording system is expected to be practically used in the future.

The process of manufacturing a magnetic head by using the longitudinal magnetic recording system that are practically used at present contains:

(a) a step of forming plural magnetic head elements each containing a recording element for writing information into a recording medium and a reproducing element for reproducing information recorded in a recording medium while arranging the magnetic head elements on a wafer substrate;

(b) a step of cutting out the magnetic head elements from the wafer substrate every bar-shaped block comprising a predetermined number of magnetic head elements;

(c) a lapping step of polishing a floated surface of each block;

(d) a step of cutting each block into individual magnetic head elements; and etc.

In the lapping step of polishing the floated upper surface of the bar-shaped block, the polishing amount has been generally set from the viewpoint of adjusting the magnetic pole length (MR height) of the reproducing element. This is because slight magnetic force recorded in a recording medium is surely read out and thus the magnetic pole length of the reproducing element has a great effect.

Specifically, there has been hitherto adopted a method of using a measurement device for outputting a signal when the magnetic pole length of the reproducing element is set to a properly dimension, observing a signal from the reproducing element by using the measurement device while lapping the floated surface of the block and stopping the lapping work at the time point when the signal concerned is output from the reproducing element.

As described above, in the conventional lapping step, the polishing amount is set from the viewpoint of adjusting the magnetic pole length of the reproducing element, however, no attention has been paid to the magnetic pole length of the recording element. The reason for this is as follows. That is, the recording density is lower in the longitudinal magnetic recording system than that in the perpendicular magnetic recording system. Therefore, even when the magnetic pole length of the recording element is not strictly considered in the lapping step of the floated surface, it has little effect on the characteristic.

However, with respect to the magnetic head of the perpendicular magnetic recording system having higher recording density, developments to further enhance the recording density have been recently advanced.

BRIEF SUMMARY OF THE INVENTION

Under the circumstance described above, the inventors have been dedicated to studies, and have completed this invention.

That is, the present invention has an object to provide a perpendicular magnetic recording type magnetic head that can implement higher recording density by considering the magnetic pole length of the recording medium too when the floated surface is lapped.

In order to attain the above object, according to a first aspect of the present invention, there is provided a method of manufacturing a magnetic head element, comprising the steps of:

forming a plurality of magnetic head elements each containing a reproducing element for reading out information recorded in a recording medium and a vertical magnetic recording type recording element for writing information into the recording medium while arranging the magnetic head elements on a substrate;

cutting out the magnetic head elements thus arranged every bar-shaped block comprising a predetermined number of the magnetic head elements;

grinding/lapping a floated surface of each block; and cutting each block into individual magnetic head elements, wherein the grinding/lapping step contains an angle adjusting step of adjusting the angle of the floated surface of each block with respect to a surface of the substrate on which the magnetic head elements are formed and grinding the floated surface concerned, and a lapping step of lapping the floated surface at the angle adjusted in the angle adjusting step.

Here, the "floated surface" is a face confronting a recording medium, and it is also called as ABS (Air Bearing Surface). Normally, this floated surface is polished by a lapping device. In the present invention, before a final lapping step, the angle of the floated surface is adjusted in advance (angle adjusting step), and after the adjustment step, the floated surface is polished in the lapping step.

By adjusting the angle of the floated surface, the processing can be performed while finely adjusting the magnetic pole length of each of the recording element and the reproducing element, and magnetic heads each having a stable characteristic can be manufactured with high yield.

It is preferable that in the angle adjusting step, the angle of the floated surface with respect to the magnetic-head-element formed surface of the substrate is adjusted on the basis of the following factors:

(1) generation dispersion of each of the magnetic pole length of the writing element and the magnetic pole length of the reading element;

(2) difference in dimension between the magnetic pole length of the writing element and the magnetic pole length of the reading element; and (3) the difference in dimension between the magnetic pole length of the writing element and the magnetic pole length of the reading element and the distance between the writing and reading elements.

In any case, not only the magnetic pole length of the reading element, but also the magnetic pole length of the writing element is considered, and thus a recording head that can implement higher recording density can be manufactured.

Here, according to experiments of the inventors of this application, excellent results have been achieved when the intersecting angle of the floated surface to the magnetic-head-element formed surface of the substrate is set to an angle in the range of 90°±0.3°.

Furthermore, according to a second aspect of the present invention, there is provided a magnetic head including a magnetic head element comprising a reading element for reading out information recorded in a recording medium and a perpendicular magnetic recording type writing element for writing information into the recording medium, the magnetic head element being formed on a substrate, wherein the intersecting angle of a floated surface on the substrate to a magnetic-head-element formed surface of the substrate is adjusted to an angle within 90°±0.3°.

Furthermore, according to a third aspect of the present invention, there is provided an angle setting device for setting a grinding angle of a floated surface of a bar-shaped block on which plural magnetic head elements each comprising a reproducing element for reading out information recorded in a recording medium and a vertical magnetic recording type recording element for writing information into the recording medium are formed and arranged on a substrate, wherein the angle setting device includes a jig for supporting the block, an angle adjusting instrument for adjusting the angle of the floated surface with respect to a predetermined reference face of the block concerned, and an angle measuring unit for optically detecting the angle concerned. By using the angle setting device, the angle adjustment can be efficiently performed.

Still furthermore, according to a fourth aspect of the present invention, a lapping device for lapping a floated surface of a bar-shaped block on which plural magnetic head elements each comprising a reproducing element for reading out information recorded in a recording medium and a perpendicular magnetic recording type recording element for writing information into the recording medium are formed and arranged on a substrate comprises a lapping surface plate, and a holding unit having an angle adjusting mechanism for holding a jig so that the jig supports the block and positioning the floated surface of the block concerned in parallel to the lapping surface plate. By using the lapping device thus constructed, a finishing lapping step can be efficiently executed.

According to the present invention, a perpendicular magnetic recording type recording head for which high recording density can be implemented can be manufactured while attention is paid to the magnetic pole length of the writing element when the floated surface is lapped.

BRIEF DESCRIPTION OF THE DRAWINGS

Accompanying the specification are figures which assist in illustrating the embodiments of the invention, in which.

DETAILED DESCRIPTION OF THE INVENTION

Preferred embodiments according to the present invention will be described hereunder with reference to the accompanying drawings.

A method of manufacturing a magnetic head according to the present invention includes a step of forming magnetic head elements on a wafer substrate, a slider bar cut-out step, a grinding/lapping step and a slider bar cutting step.

Figure 1A:
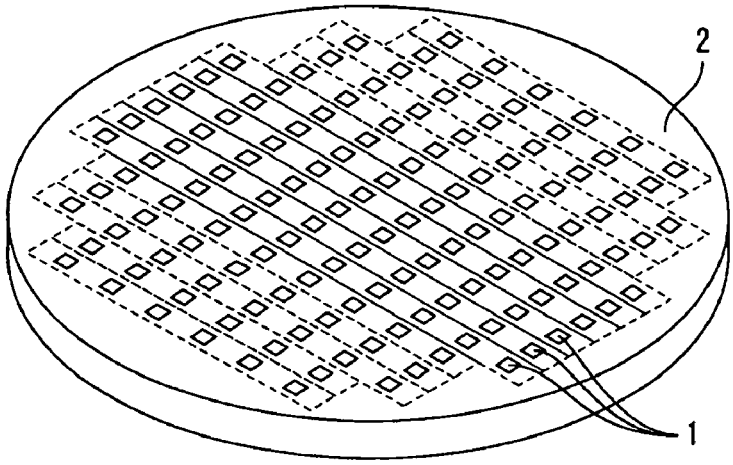
FIG. 1A is a perspective view showing the outlook of a wafer substrate having magnetic head elements formed thereon.
Figure 1B:
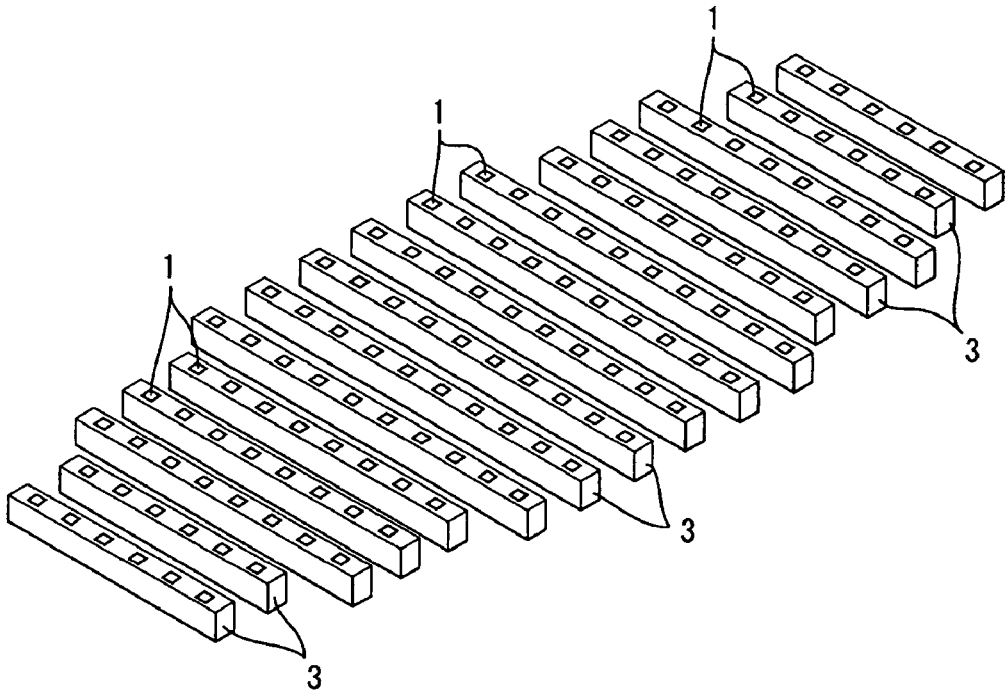
FIG. 1B is a perspective view showing a state where slider bars are cut out from the wafer substrate.

In the step of forming the magnetic head elements on the wafer substrate, a plurality of magnetic head elements 1 are formed and arranged on a wafer substrate 2 formed of ALTIC ($Al_2O_3$—TiC) or the like as shown in FIG. 1A.

Subsequently, in the slider cut-out step, the magnetic head elements thus arranged are cut out every bar-shaped block comprising a predetermined number of magnetic head elements. Each of the blocks thus cut out will be referred to as "slider bar" 3.

Figure 2:
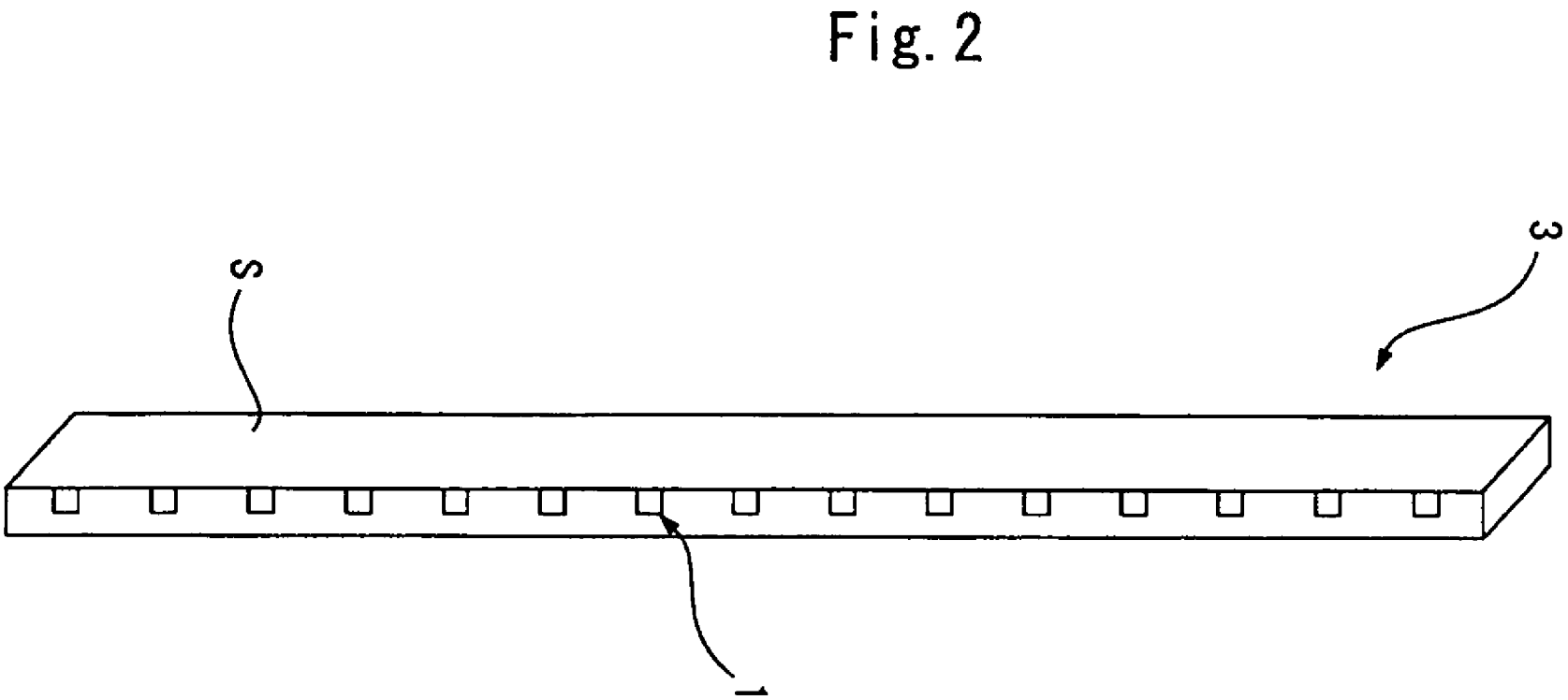
FIG. 2 is a perspective view showing the outlook of a slider bar.

FIG. 2 is an enlarged view of the outlook of the slider bar. In FIG. 2, a surface indicated by S is a floated surface of the slider bar (block) facing a recording medium. The floated surface S will be a target surface to be ground and lapped in the grinding/lapping step described later.

Figure 3:
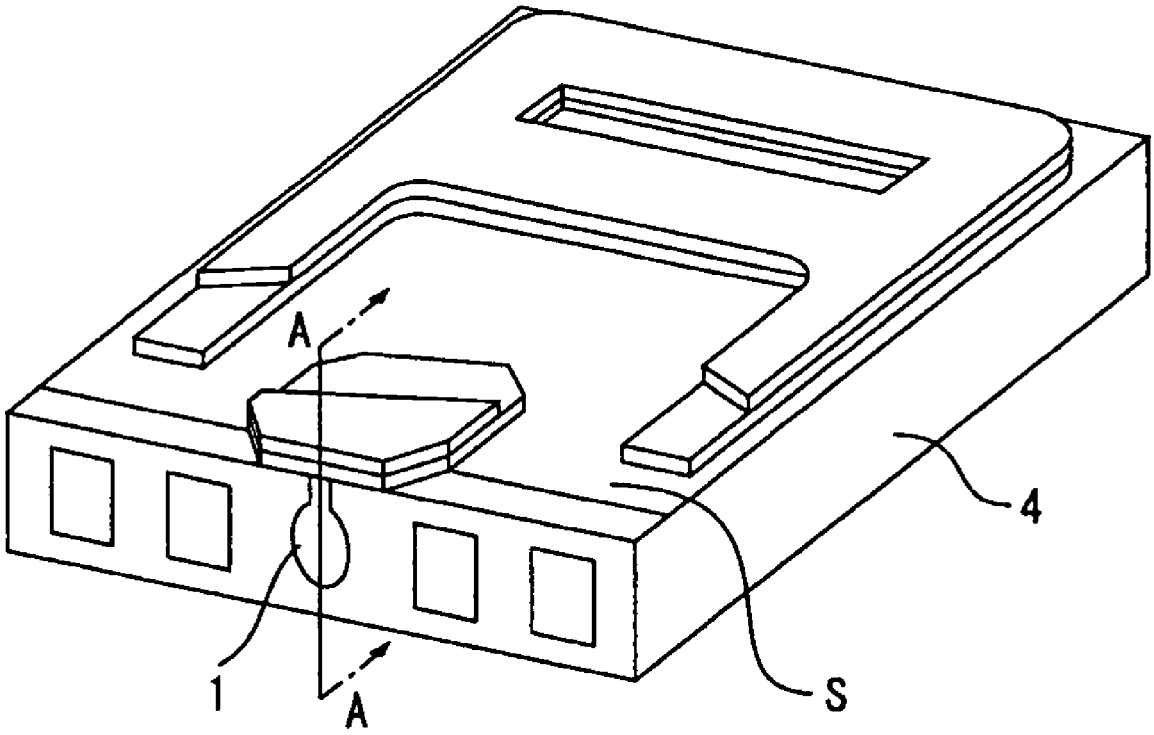
FIG. 3 is a perspective view showing a slider having a magnetic head.

Here, an example of the magnetic head will be briefly described with reference to FIGS. 3 and 4.

The slider bar 3 shown in FIG. 2 is cut into sliders each of which is equipped with a magnetic head at a relevant part in the slider bar cutting step. FIG. 3 is a perspective view showing the outlook of each slider thus cut out and separated. A magnetic head element 1 (hereinafter referred to as "magnetic head") is formed at a part of the slider 4.

Figure 4:
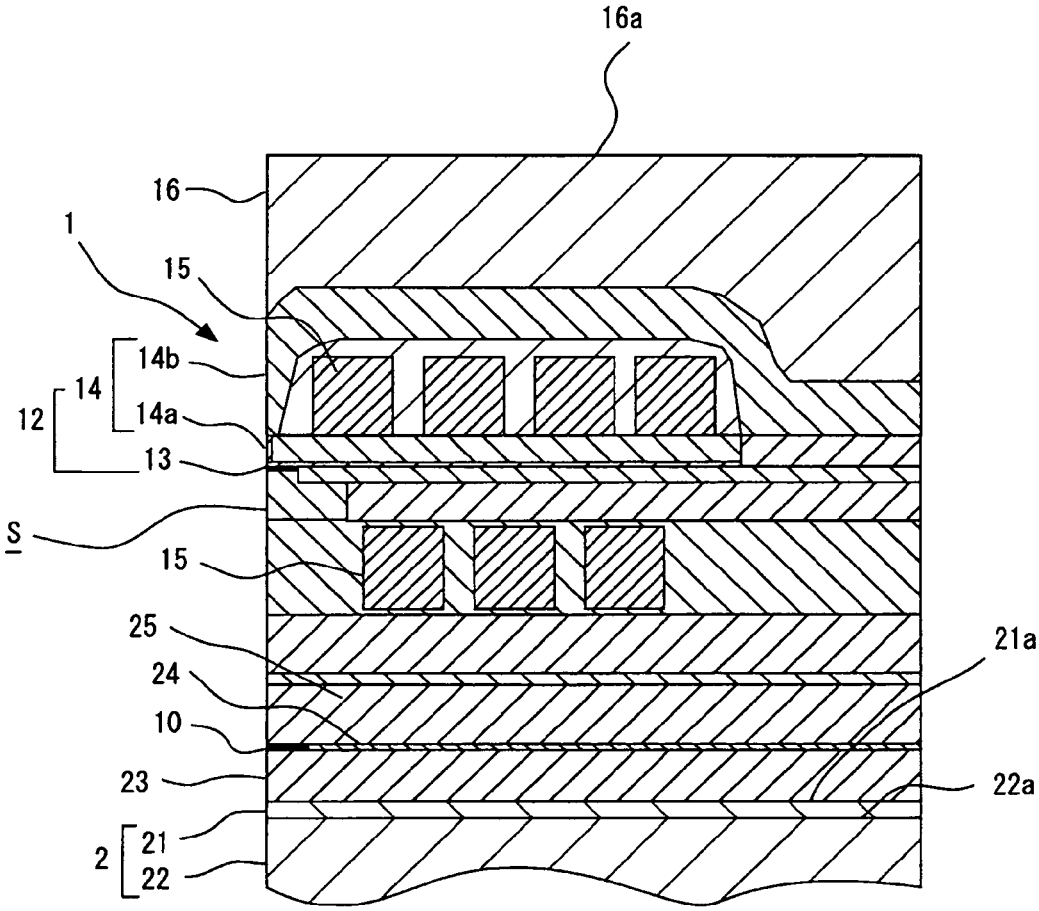
FIG. 4 is a cross-sectional view of the magnetic head.

FIG. 4 is a cross-sectional view showing a construction of the magnetic head. The cross-section of FIG. 4 is perpendicular to the floated surface S. That is, FIG. 4 is a cross-sectional view of the part of the magnetic head element 1 which is taken along A-A line.

The magnetic head (magnetic head element 1) is constructed by laminating a reproducing head portion 11 having a reading element 10 and a recording head portion 12.

Furthermore, the wafer substrate 2 is constructed by forming a base layer 21 of insulating material such as aluminum ($Al_2O_3$) or the like on a substrate 22 formed of ALTIC ($AL_2O_3$—TiC) or the like. In FIG. 4, the substrate 22 is illustrates as being notched, however, the actual thickness of the substrate 22 is further larger than that of the magnetic head element portion formed above the substrate 22. In this embodiment, the surface 22*a* of the substrate 22 or the surface 21*a* of the base layer 21 serves as "magnetic-head-element formed surface".

A lower shield layer 23 is formed on the base layer 21, and the reading element 10 is formed above the lower shield layer 23. The reading element 10 is surrounded by an insulating layer 24 formed of aluminum ($Al_2O_3$) or the like. An upper shield layer 25 is formed on the insulating layer 24.

The recording head portion 12 is designed as a so-called perpendicular magnetic recording type, and it is mainly equipped with a main magnetic pole 13 serving as a writing element, an auxiliary magnetic pole 14 and a thin film coil 15. The auxiliary magnetic pole 14 comprises a magnetic pole portion layer 14*a* located at the floated surface S side, and a yoke portion layer 14*b* that is connected to the magnetic pole portion layer 14*a* and bypasses the thin film coil 15 along the upper side of the thin film coil 15.

An element protection film 16 formed of aluminum ($Al_2O_3$) or the like is formed on the upper magnetic pole 14. The surface 16*a* of the element protection film 16 is polished so as to be parallel to the surface 22*a* of the substrate 22 and the surface 21*a* of the base layer 21 (that is, the magnetic-head-element formed surface). Each surface of the element protection film 16, the substrate 22 and the base layer 21 is parallel to the reading element 10 and the main magnetic pole 13 serving as the writing element.

The manufacturing method of the present invention is applicable to not only the manufacturing of the magnetic head having the above construction, but also the manufacturing of recording heads having various kinds of constructions each including a writing element and a reading element.

Next, the grinding/lapping step will be described.

The grinding/lapping step is further divided into an angle adjusting step and a finishing lapping step.

In the angle adjusting step, the angle of the floated surface S of the slider bar 3 is adjusted with respect to with respect to the magnetic-head-element formed surface on the substrate 22 to grind the floated surface concerned. Here, the magnetic-head-element formed surface as a reference face for the angle adjustment is the surface 22*a* of the substrate 22 or the surface 21*a* of the base layer 21*a*. Furthermore, as described above, the surface 16*a* of the element protection film 16 is polished so as to be parallel to the surface 22*a* of the substrate 22 and the surface 21*a* of the base layer 21. Therefore, even when the surface 16*a* of the element protection film 16 is set as a reference face for the angle adjustment, it is consequently possible to carry out the angle adjustment of the floated surface S with reference to the magnetic-head-element surface on the substrate 22. In this embodiment, on the basis of the mutual relationship between the surfaces described above, the angle of the floated surface S of the slider bar 3 is adjusted with the surface 16*a* of the element protection film 16 as a reference face.

Figure 5:
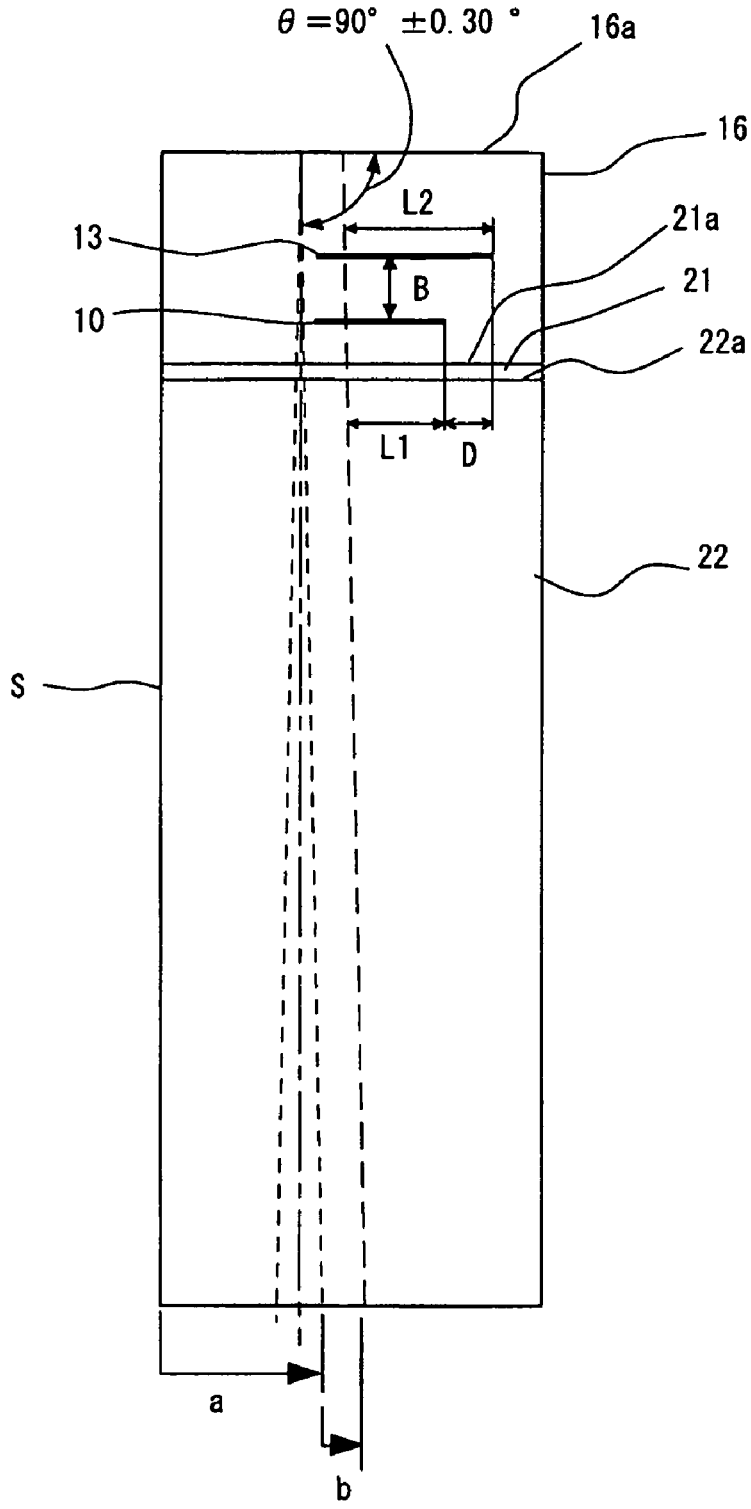
FIG. 5 is a diagram showing an angle adjusting method of a floated surface of a slider bar.

FIG. 5 is a diagram showing the angle adjustment method of the floated surface of the slider bar.

The floated surface S of the slider bar 3 is ground and lapped at a predetermined angle θ with the surface 16*a* of the element protection film 16 (that is, the surface of the substrate 22 or the surface of the base layer 21, hereinafter referred to as "the surface on the substrate 22"). Specifically, in the angle adjusting step, the floated surface S of the slider bar 3 is ground until the position indicated by a reference numeral a in FIG. 5, and then in the finishing lapping step, the floated surface S is polished until the position indicated by a reference numeral b in FIG. 5.

The angle θ is determined in consideration of the magnetic pole length L2 of the writing element 13 in addition to the magnetic pole length L1 of the reading element 10. Specifically, it is preferable that the angle θ is determined in consideration of at least one of the following factor:

(1) generation dispersion of each of the magnetic pole length L2 of the writing element 13 and the magnetic pole length L1 of the reading element 10;

(2) dimensional difference D between the magnetic length L2 of the writing element 13 and the magnetic pole length L1 of the reading element 10; and (3) the dimensional difference D between the magnetic pole length L2 of the writing element 13 and the magnetic pole length L1 of the reading element 10 and the distance B between these elements.

Here, L1, L2, D and B are theoretical values (values in design).

A calculation example of when the factor (3) is used will be described. The angle θ can be calculated according to the following equation.

$$\theta = \mathrm{Tan}^{-1}(|D - Da|/Ba)$$

In the above equation, $D_a$ represents the dimensional difference (actually measured value) in magnetic pole length between the writing element 13 and the reading element 10 when the magnetic pole length of each of the writing element 13 and the reading element 10 are actually measured. $B_a$ represents the actually measured value of the distance between the writing and reading elements 13 and 10.

For example, when the theoretical values (values in design) of L1, L2, B and D are set so that L1=100 nm, L2=130 nm, B=6.5 μm and D=30 nm, and the actually values are equal to 6.5 μm and $D_a$=35 nm, θ=0.043° by applying the above values to the equation.

In the actual manufacturing process, the following dispersions case are observed in the values of $B_a$ and $D_a$: $B_a$ is in the range of 6.5 0.5 μm and $D_a$ is in the range of 30 30 nm. When the angle θ is calculated on the basis of the dispersion values of $B_a$ and $D_a$ when the dispersion values $B_a$ and $D_a$ are maximum (for example, B=6.0 μm, D=60 nm), the angle θ is equal to 0.29°.

As described above, according to the experiments executed by the inventors, when the angle θ is set in the range of 90°±0.3°, preferably in the range of 90°±0.15°, vertical magnetic recording heads having characteristics that can implement high density recording can be manufactured with high yield.

Figure 6A:
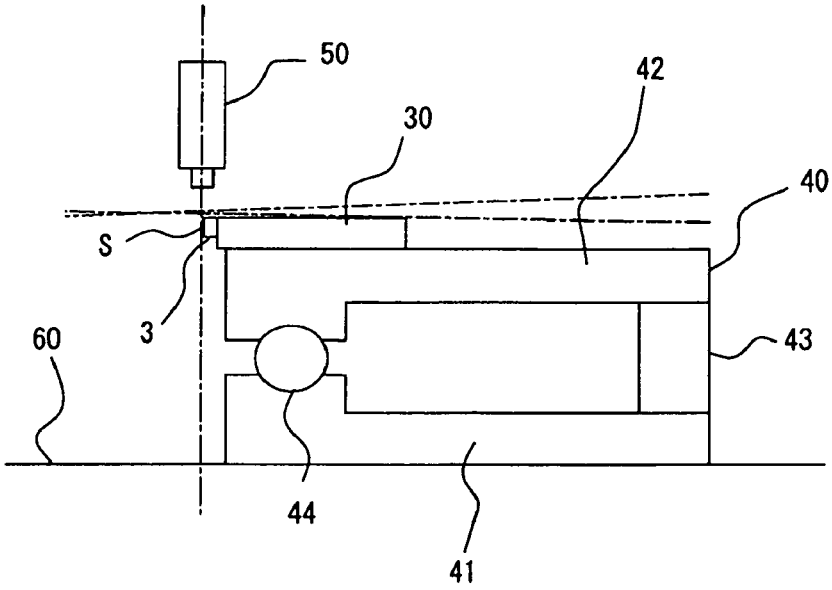
FIG. 6A is a diagram showing an angle setting device used for an angle adjustment step.
Figure 6B:
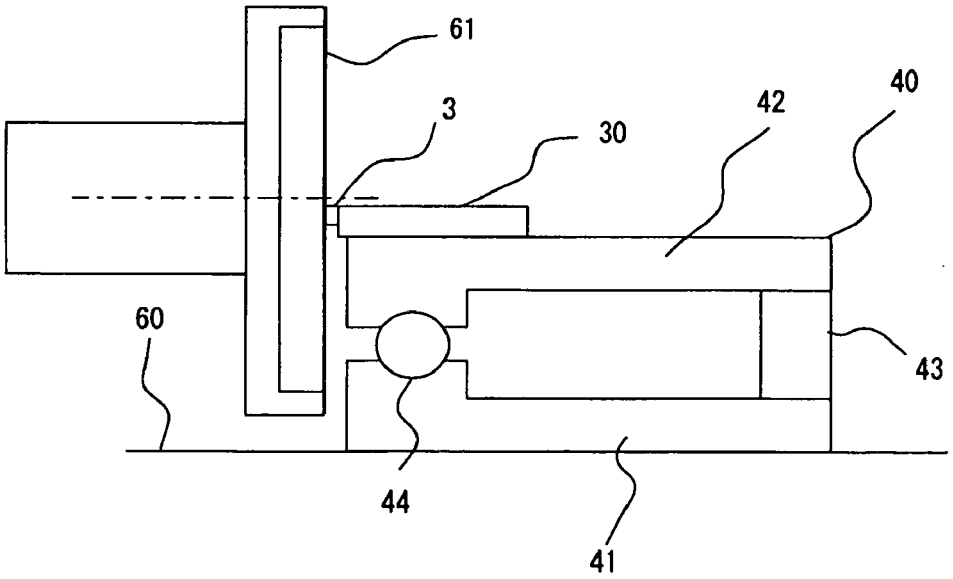
FIG. 6B is a diagram showing a grinding device used for the angle adjustment step.

FIG. 6A is a diagram showing an angle setting device used in the angle adjusting step, and FIG. 6B is a diagram showing a grinding device used in the angle adjusting step.

As shown in FIG. 6A, the angle setting device comprises a jig 30 for supporting the slider bar 3, an angle adjusting instrument 40 and an angle measuring unit 50.

The slider bar 3 is fixed to the jig 30 while the floated surface S thereof is disposed at the outer side. The jig 30 is mounted on a movable table of the angle adjusting instrument 40. The angle adjusting instrument 40 is equipped with a base table 41, the movable table 42 and an electromechanical angle correcting mechanism (for example, an actuator 43 formed of a piezoelectric element or the like). The movable table 42 is connected to the base table 41 through a hinge 44 at one side thereof, and it is driven by the actuator 43 at the other side thereof. That is, the movable table 42 swung around the hinge 44 by the driving force of the actuator 43.

The angle adjusting instrument 40 is disposed on the upper surface of a horizontal table 60, and the floated surface S of the slider bar 3 fixed to the jig 30 is set up so that when the floated surface S is vertical to the upper surface of the table 60, the surface 16*a* of the element protection film 16 is parallel to the upper surface of the table 60. The actuator 43 is driven from the above set-up state to incline the floated surface S, thereby adjusting the angle of the floated surface S.

Furthermore, an optical angle measuring unit 50 such as a laser auto-collimator or the like is disposed on the upper surface of the table 60, and the angle of the floated surface S with respect to the upper surface of the table 60 (that is, the surface 16*a* of the element protection film 16) is measured with high precision by the angle measuring unit 50.

The actuator 43 of the angle adjusting unit 40 is controlled on the basis of the angle of the floated surface S measured by the angle measuring unit 50. As described above, the angle of the floated surface S of the slider bar 3 is adjusted to a preset angle θ with respect to the surface 16*a* of the element protection film 16.

After the angle adjustment of the floated surface S of the slider bar 3 is finished, the floated surface S of the slider bar 3 is ground by a grinding machine 61. The grinding machine 61 is disposed so that the grinding face thereof is vertical to the upper surface of the table 60. Accordingly, the floated surface S of the slider bar 3 is ground while held at an angle θ set by the angle adjusting instrument 40. The grinding amount of the floated surface S is set to about 20 to 30 μm, and in the subsequent finishing lapping step, the floated surface S is further polished by the amount of about 6 to 7 μm. By reducing the polishing amount in the finishing lapping step, the grinding/lapping step can be efficiently performed in short time.

Figure 7:
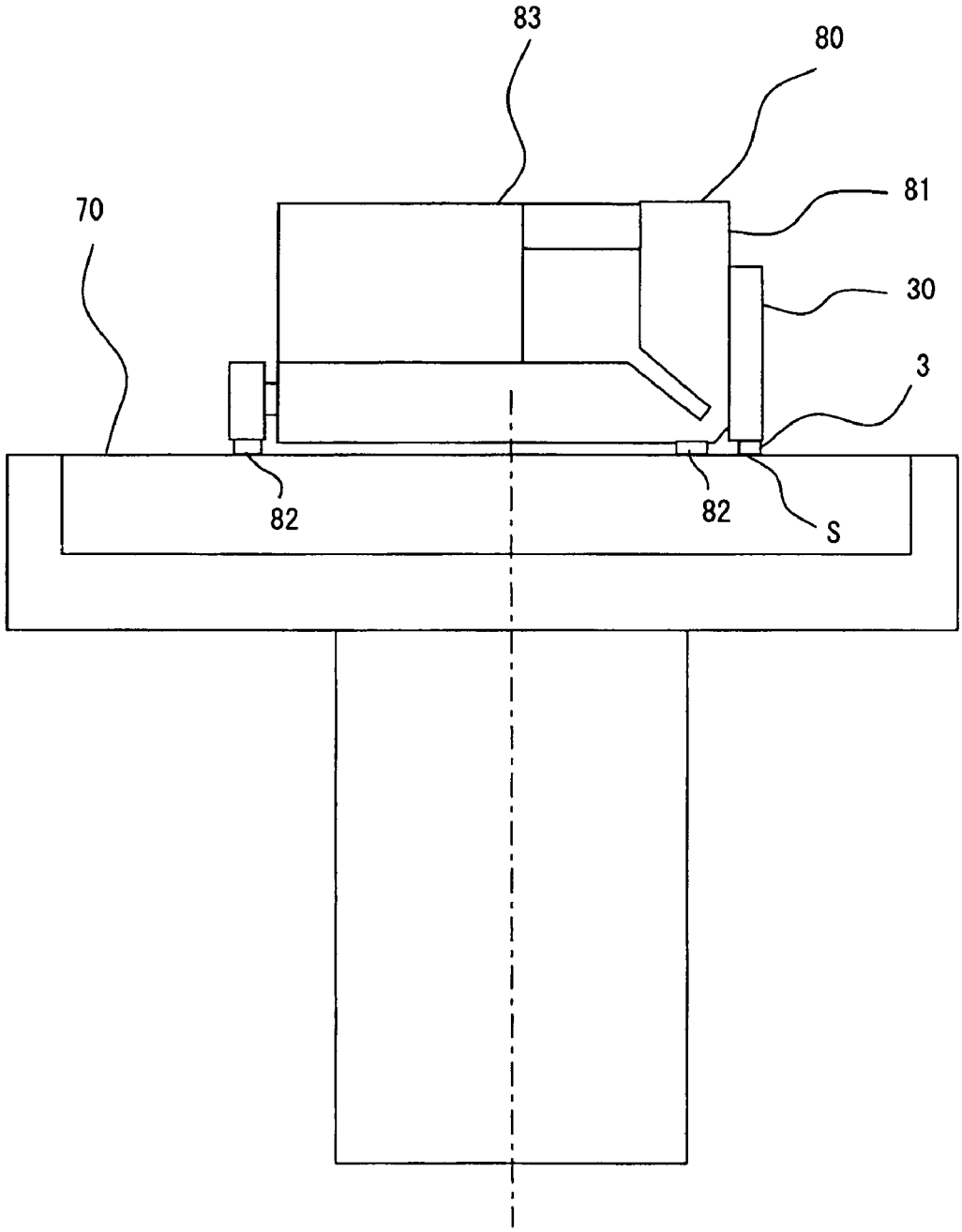
FIG. 7 is a diagram showing a lapping device used for a finishing lapping step.

FIG. 7 is a diagram showing the lapping device used in the finishing lapping step.

The lapping device is equipped with a holding unit 80 disposed so as to face the lapping machine 70. The holding unit 80 is designed so that the side portion 81 thereof is freely swung with reference to the bottom surface thereof, and the jig 30 is mounted on the outer surface of the side portion 81. At this time, the jig 30 is mounted with the floated surface S of the slider bar 3 placed face down.

Plural (two in FIG. 7) dummy bars 82 are mounted on the bottom surface of the holding unit 80. The dummy bars 82 are processed so that the floated surfaces S thereof are vertical to the magnetic-head-element formed surface on the substrate 22. The holding unit 80 is positioned so that the floated surfaces S of the dummy bars 82 come into contact with the lapping machine 70 in parallel.

An electromechanical angle correcting mechanism (for example, an actuator 83 formed of a piezoelectric element or the like) is equipped to the holding unit 80, and the side portion 81 can be swung by the driving force of the actuator 83. By swinging the side portion 81, the floated surface S of the slider bar 3 fixed to the jig 30 is positioned to be parallel to the lapping machine 70.

Angle data set in the angle adjusting step are used to control the actuator 83. Specifically, the actuator 83 is driven on the basis of the angle data, whereby the floated surface S which is ground to achieve a predetermined angle θ with respect to the magnetic-head-element formed surface on the substrate 22 (that is, an intersecting angle θ to the magnetic-head-element formed surface on the substrate 22) is automatically disposed in parallel to the lapping machine 70.

In the finishing lapping step, the floated surface S is polished in parallel while keeping the angle θ set in the angle adjusting step. In consideration of a mechanical error or the like, fine adjustment can be carried out so that each of the elements 10 and 13 is processed to have a desired length while measuring the electrical resistance of each of the elements 10 and 13.

The slider bar 3 whose floated surface S has bee ground and lapped as described above is cut into individual magnetic head elements in the next slider cutting step. The slider cutting step is executed in the same manner as the conventional magnetic head manufacturing process, and thus the detailed description thereof is omitted.

The present invention is not limited to the above embodiments, and various modifications may be made without departing from the subject matter of the present invention.

For example, the angle adjusting step may be executed without using the angle setting device shown in FIG. 6, and the finishing lapping step may be executed without using the holding unit shown in FIG. 7.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

What is claimed is:

1. A method of manufacturing a magnetic head, comprising the steps of:

forming a plurality of magnetic head elements each including a reading element for reading out information recorded in a recording medium and a perpendicular magnetic recording writing element for writing information into the recording medium while arranging the magnetic head elements on a substrate;

cutting out bar-shaped blocks of the magnetic head elements thus arranged, each of the bar-shaped blocks comprising a predetermined number of the magnetic head elements;

grinding and lapping a floated surface of each of the blocks; and cutting each of the blocks into individual magnetic head elements, wherein the grinding and lapping steps include an angle adjusting step of adjusting the angle of the floated surface of each of the blocks with respect to a surface of the substrate on which the magnetic head elements are formed and grinding the floated surface concerned and a lapping step of lapping the ground floated surface at the angle adjusted in the angle adjusting step, and the angle adjusting step includes a step of adjusting the angle of the floated surface with respect to the magnetic-head-element formed surface on the substrate on the basis of a dimensional difference between a magnetic pole length of the writing element and a magnetic pole length of the reading element.

2. The method of claim 1, wherein the angle is adjusted to 90°±0.3°.

3. A method of manufacturing a magnetic head, comprising the steps of:

forming a plurality of magnetic head elements each including a reading element for reading out information recorded in a recording medium and a perpendicular magnetic recording writing element for writing information into the recording medium while arranging the magnetic head elements on a substrate;

cutting out bar-shaped blocks of the magnetic head elements thus arranged, each of the bar-shaped blocks comprising a predetermined number of the magnetic head elements;

grinding and lapping a floated surface of each of the blocks; and cutting each of the blocks into individual magnetic head elements, wherein the grinding and lapping steps include an angle adjusting step of adjusting the angle of the floated surface of each of the blocks with respect to a surface of the substrate on which the magnetic head elements are formed and grinding the floated surface concerned and a lapping step of lapping the ground floated surface at the angle adjusted in the angle adjusting step, and the angle adjusting step includes a step of adjusting the angle of the floated surface with respect to the magnetic-head-element formed surface on the substrate on the basis of a dimensional difference between a magnetic pole length of the writing element and a magnetic pole length of the reading element and the distance between a writing element and the reading element.

4. The method of claim 3, wherein the angle is adjusted to 90°±0.3°.

* * * * *